United States Patent [19]

Lea et al.

[11] Patent Number: 4,633,678

[45] Date of Patent: Jan. 6, 1987

[54] KEG COOLER

[76] Inventors: Randy J. Lea, Richard P. Lea, both of Springfield, Mo. 65803

[21] Appl. No.: 778,913

[22] Filed: Sep. 23, 1985

[51] Int. Cl.[4] ..... F25D 3/08

[52] U.S. Cl. ..... 62/457; 62/464; 62/465; 62/400; 220/466; 220/434

[58] Field of Search ..... 62/459, 463, 464, 465, 62/371, 398, 400; 220/411, 413, 428, DIG. 1, 432, 434, 466; 206/519

[56] References Cited

U.S. PATENT DOCUMENTS

| | | | |
|---|---|---|---|
| 2,003,050 | 5/1935 | Iselin . | |
| 2,080,598 | 5/1937 | Bodenstab | 62/464 |
| 2,100,309 | 11/1937 | Bender | 220/466 X |
| 2,792,692 | 5/1957 | Bryan | 62/465 X |
| 2,917,906 | 12/1959 | Woolley | 62/457 X |
| 3,308,636 | 3/1967 | Schaaf | 62/457 X |
| 3,443,397 | 5/1969 | Donovan et al. | 62/398 |
| 3,614,875 | 10/1971 | McCallun | 62/464 X |
| 3,789,622 | 2/1974 | Yanes | 62/396 |
| 4,042,142 | 8/1977 | Ruano | 220/4 B |
| 4,481,791 | 11/1984 | German | 62/400 |
| 4,483,152 | 11/1984 | Human | 62/400 |
| 4,519,219 | 5/1985 | Prepodnik et al. | 62/464 X |

*Primary Examiner*—Lloyd L. King

*Attorney, Agent, or Firm*—Kokjer, Kircher, Bradley, Wharton, Bowman & Johnson

[57] ABSTRACT

A beer keg cooler has a container and a removable lid of relatively thick wall insulated construction larger than a keg to be accommodated by the cooler so that ice may be packed around the keg. A flexible, web shaped harness is secured to the inner wall of the container and straps of the harness are secured by buckles so that the harness can be adjusted to bridge across the container in tight engagement against the keg to secure the keg in position and to prevent the keg from floating as the ice melts. The container has a notch formed in its upper rim to accommodate beverage dispensing equipment and the lid has a central opening for the same purpose. A flexible flap over the lid opening seals any portion of the opening not required for this purpose.

9 Claims, 8 Drawing Figures

KEG COOLER

This invention pertains to beverage coolers, and more particularly to a cooler for maintaining a beverage keg such as a beer keg cooler with packed ice during the storage and dispensing of the contents.

Beer is commonly sold in kegs and beer is dispensed directly from the keg during picnics, parties and the like. In order to keep the beer cold, it is often placed in a tub or vat where it is surrounded by crushed ice. Insulted containers have heretofore been suggested to retard the melting of the ice and to lengthen the time during which kegs of this type can be kept cool.

A major disadvantage with heretofore available coolers for this purpose has been that the keg has a tendency to float in the water from the melted ice. So long as the ice remains frozen and the keg remains full, no substantial problem of this kind is encountered. However, as the ice melts and as the contents are drawn from the keg, the latter floats on the water, preventing a large portion of the keg from contacting the cooling ice. As a result, the contents of the keg become warm and unpalatable. Further, the floating keg presents major problems of handling wherein inconvenience to the user results. The contents of the floating keg often spill during the dispensing operation. Such spillage, when added to the warm temperature of the beer, substantially diminishes the pleasure which would otherwise accompany the provision of the beverage on such occasions. These problems often militate against the later use of quantities of the beer which are not consumed at the principal outing for which the keg was initially obtained. Thus, this remaining beer is usually wasted.

A number of previous attempts have been made to alleviate at least some of these problems. A variety of different insulated containers have been suggested for advantageously cooling kegs of this type with ice. Many of these have concentrated on cooler designs attempting to increase the efficiency of the coolant and to retard the melting process. Examples of these approaches include U.S. Pat. No. 4,042,142 to Ruano which discloses a three part container shaped generally in the form of a keg and having a bottom projection to support the keg in position with coolant contacting the keg bottom. Another somewhat similar suggestion is contained in U.S. Pat. No. 4,481,791 to German which shows a cooler with an invertible lid to accommodate various sizes of kegs. U.S. Pat. No. 3,789,622 to Yanes discloses a portable, barrel shaped cooler adapted to hold the keg in a horizontal position.

U.S. Pat. No. 3,443,397 to Donovan et al., U.S. Pat. No. 3,614,875 to McCallun, and U.S. Pat. No. 4,483,152 to Human all present suggestions for keg coolers wherein the ice or coolant is prepackaged so that it either does not come into intimate contact with the keg to float the latter, or it is not confined in a rigid vat wherein the confined water will tend to float the keg. All of these suggestions raise additional problems of convenience for the user which obviously detract from the suitability of such devices for solution of the overall problems.

U.S. Pat. No. 2,792,692 to Bryan suggests construction of an ordinary barrel with an internal cross brace to be fitted in the barrel across the keg for holding the keg in an upright position on the barrel floor. While such construction may accomplish the desired result, it is unwieldly and cannot be readily utilized with any of a variety of different sized kegs. Another more elaborate and even more unwieldly structure for positioning a barrel shaped keg in a cooler is disclosed in U.S. Pat. No. 2,003,050 to Iselin. This device comprises a container fitted with a plurality of rigid supports projecting inwardly from the container wall and adapted to provide support for the keg. These supports are adjustable but would be extremely difficult to adjust after installation of the keg in the container due to the rigid nature of the support members. The complicated nature of the construction would also render devices as suggested by Iselin relatively expensive and not likely to be accessible to the ordinary user.

Accordingly, it is a primary object of the present invention to provide a cooler for a beer keg or the like which is highly efficient for maintaining the keg in its proper position irrespective of the quantity of material in the keg, yet which is simple and inexpensive in construction and easy to use.

Another very important object of this invention is to provide a cooler container fitted with a flexible harness which may be quickly and easily applied to a variety of kegs of different sizes and shapes for holding the keg in proper position during use of the cooler.

As a corollary of the foregoing object, it is also an object of the invention to provide a container which may be relied upon to prevent a keg from floating during use of the cooler to thereby insure that the keg contents are kept cool throughout the entire operation.

A still further object of the invention is to provide a novel keg cooler which is particularly constructed with a highly insulated wall construction throughout to protect the contents from ambient temperature conditions, and which includes a flexible web harness which is easily applied to any size and shape of keg to hold the keg in its proper position in the coolant in the container at all times.

Another object of this invention is to provide such a cooler having appropriate openings to accommodate beverage dispensing equipment to permit the dispensing of beverage from the keg while keeping the container closed at all times during use to extend the period of time before the ice melts and is no longer able to cool the keg contents.

These and other important aims and objectives of the present invention will be further explained or, will become apparent from the following claims and explanation of the drawings, in which:

Figure 3:
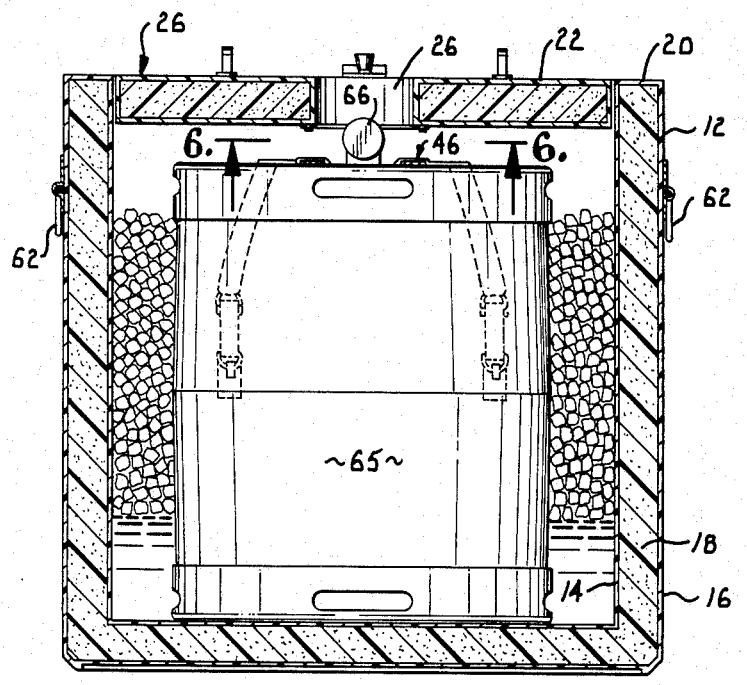
FIG. 3 is a cross sectional view taken along line 3—3 of FIG. 2.

A cooler embodying the principals of this invention is broadly designated by the reference numeral 10 and comprises a container 12 of preferably cylindrical shape comprising inner and outer, spaced apart walls 14 and 16 having a quantity of insulating material such as polyurethane foam 18 interposed therebetween. Walls 14 and 16 extend across the bottom of the container closing the latter as best shown in FIG. 3 of the drawing.

Figure 1:
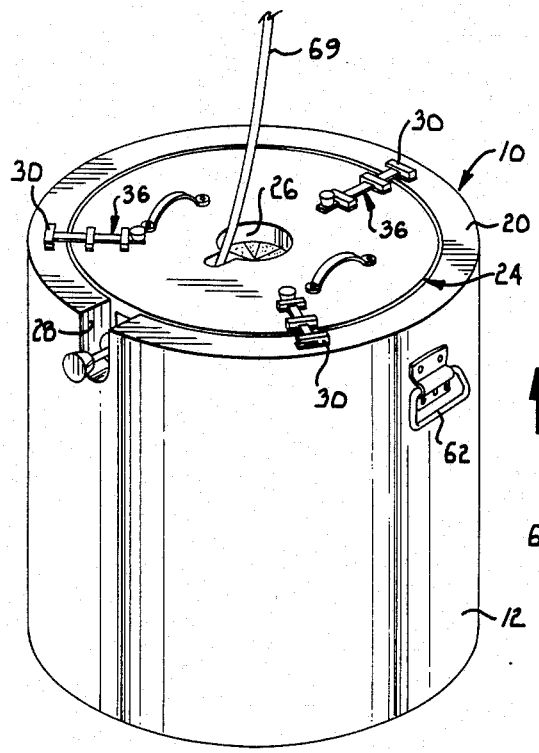
FIG. 1 is a perspective view of a container embodying the principles of this invention.
Figure 7:
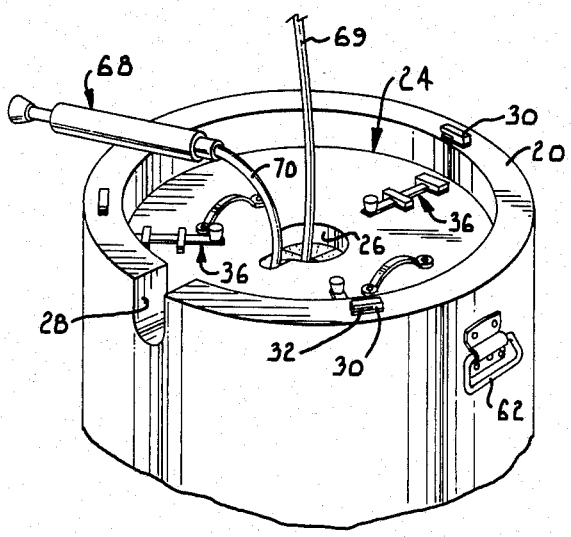
FIG. 7 is a fragmentary view similar to FIG. 1 but illustrating the cover in an unlatched condition and showing a pump and conduits in communication with the keg.
Figure 8:
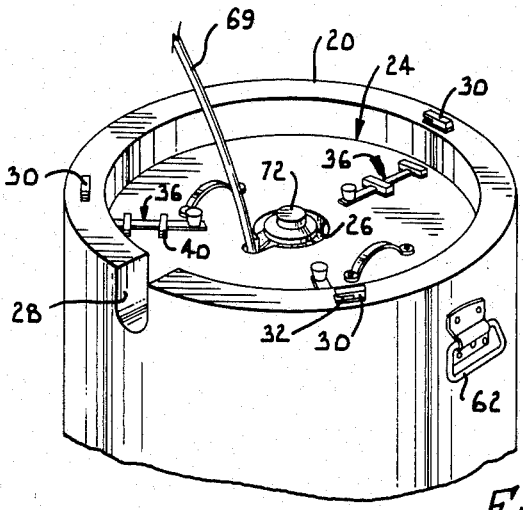
FIG. 8 is a view similar to FIG. 7 but illustrating a position of the container cover with the top of a keg projecting therethrough.

The uppermost rim 20 of container 12 is substantially flat and is coplanar with the uppermost wall 22 of a removable closure or lid 24 constructed with spaced apart walls and intermediate insulation in the manner heretofore described with respect to container 12. A centrally located, keyhole shaped opening 26 is formed in lid 24 and extends therethrough as shown in the drawing. Additionally, a vertically extending slot or notch 28 is formed in the upper marginal portion of container 12 as illustrated in FIGS. 1, 7 and 8.

Brackets 30 are mounted on rim 20 at uniformly spaced apart locations therearound and each bracket is provided with a notch 32 adapted to receive the sliding bolt 34 of a latch assembly 36 mounted on lid 24. As shown in the drawings, there is a latch assembly 36 provided for each bracket 30 and the bolts 34 have knobs 38 secured thereto to permit rectilinear sliding movement of the bolts 34 in their respective retainers 40. The assemblies 36 cooperate with the brackets 30 to releasably secure the lid in position on container 12 with the upper surface of the lid coplanar with the container rim 20 as will be readily understood by those skilled in the art.

Figure 6:
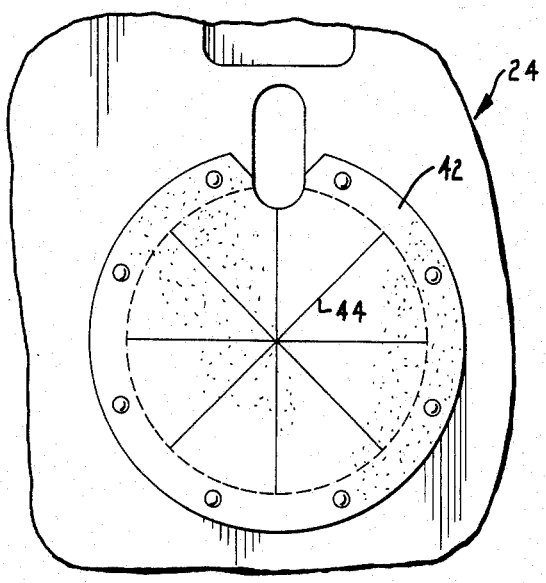
FIG. 6 is an enlarged fragmentary bottom elevational view taken along line 6—6 of FIG. 3.

A generally circular disc 42 of resilient material is secured around its peripheral rim to the underside of lid 24 as shown best in FIG. 6 of the drawing. Disc 42 is provided with a plurality of radially extending cuts 44 whereby the disc normally extends in covering relationship over the circular portion of opening 26, yet the pie shaped flaps formed by the cuts 44 are yieldable to permit the projection of components of a keg to be received in the cooler through the opening as will be subsequently more fully explained.

Figure 4:
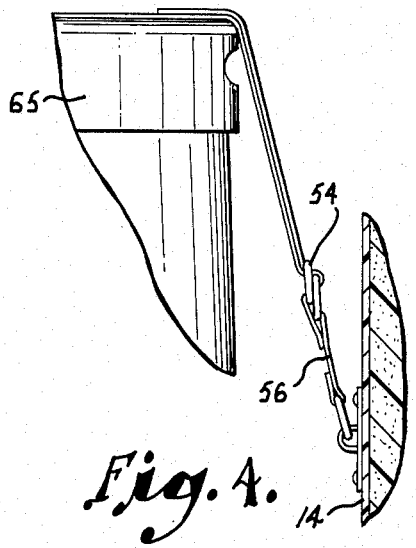
FIG. 4 is an enlarged, fragmentary view illustrating one of the straps connected to the container and showing it in position on a keg.
Figure 5:
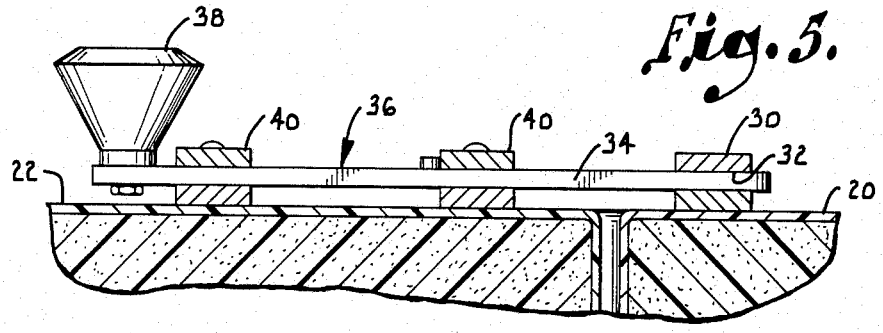
FIG. 5 is an enlarged detailed fragmentary cross-sectional view taken along line 5—5 of FIG. 2.

The interior of container 12 is fitted with a keg hold down harness 46 comprising a pair of elongated, flexible straps 48 and 50 extending in mutually spaced apart, bridging relationship across the compartment defined by container 12 as shown. One end of each of the straps 48 and 50 is secured to a corresponding D-shaped mounting loop 52 which is, in turn, pivotally coupled to the inner wall 14 of container 12. The other end of each strap is adapted to be received through a buckle 54 carried on one end of a mounting strap 56, the other end of which is fixedly secured to wall 14 of container 12 in identical fashion to that heretofore described with respect to the mounting of the strap to the container and as illustrated in FIG. 4 of the drawing. Buckle 54 is of a type which permits the free end of the corresponding strap to be passed through the buckle and drawn tightly whereupon the buckle releasably retains the strap in this condition.

Figure 2:
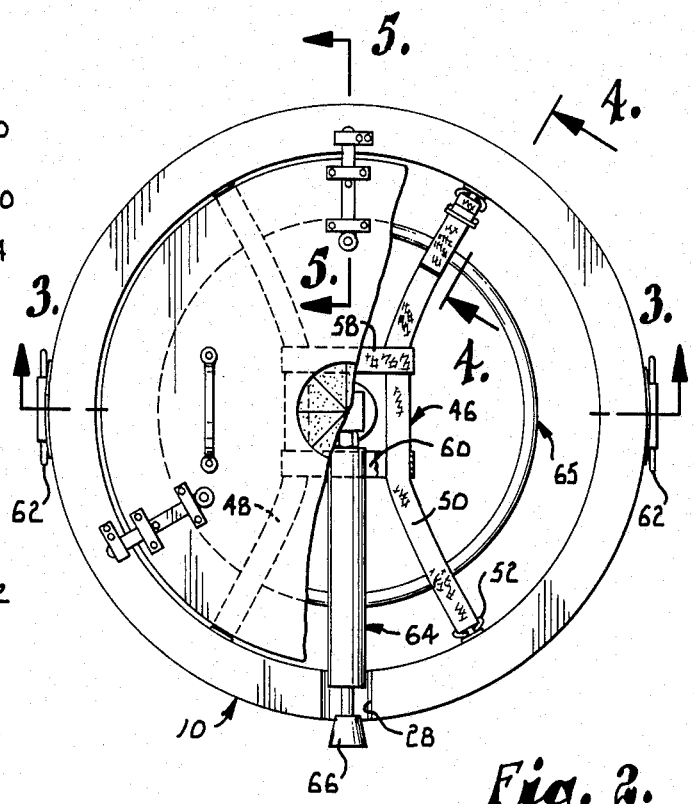
FIG. 2 is an enlarged, top plan view thereof, parts being broken away and parts appearing in phantom to reveal details of construction.

The bridging straps 48 and 50 are interconnected by cross elements in the form of a pair of spaced apart cross straps 58 and 60 as shown in FIG. 2. The interconnecting straps are preferably secured at each end to the respective straps 48 and 50 to present a generally square opening through the harness centrally of the container compartment. The hardware for mounting the ends of the bridging straps 48 and 50 are preferably positioned as shown in FIG. 2 so that the straps diverge from one another as the extremities of the straps are approached.

In order to render the cooler 10 conveniently portable, a pair of carrying handles 62 are secured to the outer wall of the container.

In operation, a beverage container such as a beer keg 65 is placed within the compartment defined by container 12 in the manner illustrated in the drawing. The harness 46 is installed over the keg as shown. Whatever accommodation may be required because of the particular size or shape of the keg is easily effected by simply adjusting the straps in their respective buckles. Desirably, the central opening of the keg is positioned in the opening in the harness web defined by the spacing between the cross straps 58 and 60 and the proximal intermediate portions of the bridging straps 48 and 50. Manifestly, if desired, both ends of the bridging straps may be made adjustable for this purpose.

After the keg is secured in the container in the manner described, a quantity of cooling ice is interposed in the container in surrounding relationship around the keg. The harness 46 holds the keg in its proper position at all times and eliminates any possibility for the keg floating upwardly as the ice melts and as the contents of the keg become progressively depleted.

The cooler can be transported to any desired location and the carrying handles 62 are useful for this purpose. When it is desired to withdraw the contents from the keg, the lid 24 may be removed for attachment of the pumping accessories. The lid is reinstalled to insure maximum insulation of the keg containing cavity to extend the cooling afforded by the ice in the container. The insulating lid can either be installed with the latches engaging the brackets 30, or it can be lowered to a position below its uppermost position as illustrated in FIGS. 7 and 8 of the drawing. In any case, the lid is constructed to afford maximum insulation to the compartment within the cooler.

The construction of the cooler is such as to afford maximum versatility for use of the cooler in accommodating a variety of sizes and types of kegs. FIGS. 1, 2 and 3 illustrate the manner in which the cooler can be used with kegs having a laterally extending pump 64 of conventional type. The handle 66 of the pump extends through the notch 28 and the delivery tube 69 may pass through the central lid opening 26. FIG. 7 shows a manner of using the cooler with a pump 68 located externally of the container and connected to the keg by a tube 70. The latter extends through the lid opening 26 as does the delivery tube 69.

In the event that the keg is equipped with a vertical stroke, integral pump 72, the lid is moved to the position shown in FIG. 8 of the drawing. The pump projects through the flexible disc 42 to ensure maximum closure around the keg and the delivery tube 68 extends through the elongated portion of the key hole shaped opening 26.

It will be readily recognized that the cooler of this invention overcomes the disadvantages discussed above which have long been attendant upon the cooling of beer kegs and the like. The keg is readily and conveniently held in proper position throughout the use of the cooler whereby the contents of the keg are kept cold at all times. By virtue of the construction utilizing a flexible web harness and by the convenient location of the lid opening and container notch, the cooler may be used with substantially any type of commercially available keg.

Having thus described the invention, we claim:

1. An assembly for cooling a beverage keg, said assembly comprising:

a container having insulated, rigid bottom and sidewall portions defining an open topped compartment of a size larger than the keg to provide space for ice around the keg within the compartment;

a removable cover for closing the top of said container to enclose the keg in said compartment; and a flexible harness including elongated flexible strap means having opposite ends secured to the container sidewall portion on the interior of the container and adapted to extend over the keg in the compartment in a taut condition to hold the keg down on the container bottom portion and against floating in the water from the melted ice, said harness being adjustable to vary the effective length of the strap means to accommodate kegs which differ in size and shape.

2. The assembly as set forth in claim 1, wherein said strap means comprises a pair of elongated, flexible straps, the opposite ends of each strap being secured to the container sidewall with each strap bridging across the compartment, the respective straps being spaced from one another.

3. The assembly as set forth in claim 2, wherein is provided a pair of spaced apart elements, each element inter-connecting the bridging straps, whereby the straps and inter-connecting elements present a flexible web adapted to fit over said keg to hold the latter down on the container bottom portion.

4. The assembly of claim 3, wherein said interconnecting elements are fixedly secured to the bridging straps at locations wherein said straps and elements conjointly define a central opening in the harness at substantially the center of said compartment, said opening being adapted to receive a keg top therethrough whereby the harness may hold the keg centered in the compartment.

5. The assembly as set forth in claim 1, wherein is provided releasable lock means on the cover and container respectively for releasably securing the cover in insulating position over the compartment.

6. The assembly as set forth in claim 5, wherein the top of said cover is substantially flat and wherein the uppermost edge of said container is substantially flat, said releasable lock means including a plurality of latching devices carried by the cover and engageable with latch parts secured to the container for releasably holding the top of the cover substantially co-planar with the upper edge of the container.

7. The assembly as set forth in claim 1, wherein said cover and said container are each provided with holes extending therethrough, said holes being adapted for the passage of conduits into the container for the withdrawal of the contents of the keg during use of the cooler assembly.

8. The assembly of claim 7, wherein the cover is provided with resilient flap means across the cover hole for covering the latter, said flap means being yieldable to permit the passage of a conduit therethrough while closing the remainder of the hole not required for the passage of said conduit.

9. The assembly as set forth in claim 6, wherein said cover is small enough to fit in the container below said uppermost edge thereof to span said sidewall portion of the container when said latching devices are released from said latch parts.

* * * * *